US007926147B2

(12) United States Patent
Saeger et al.

(10) Patent No.: US 7,926,147 B2
(45) Date of Patent: Apr. 19, 2011

(54) APPARATUS FOR THE FIBRE-SORTING OR FIBRE-SELECTION OF A FIBRE BUNDLE COMPRISING TEXTILE FIBRES, ESPECIALLY FOR COMBING

(75) Inventors: Nicole Saeger, Aachen (DE); Johannes Bossmann, Mönchengladbach (DE); Thomas Schmitz, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 376 days.

(21) Appl. No.: 12/163,287

(22) Filed: Jun. 27, 2008

(65) Prior Publication Data

US 2009/0000068 A1 Jan. 1, 2009

(30) Foreign Application Priority Data

Jun. 29, 2007 (DE) ..... 10 2007 030 471
Jun. 29, 2007 (DE) ..... 20 2007 010 686 U
Nov. 9, 2007 (DE) ..... 10 2007 053 893

(51) Int. Cl.
*D01G 19/00* (2006.01)

(52) U.S. Cl. ..... 19/217

(58) Field of Classification Search ..... 19/115 R, 19/128, 215, 216, 217
See application file for complete search history.

(56) References Cited

U.S. PATENT DOCUMENTS 1,408,780 A * 3/1922 Schleifer ..... 19/217
1,425,059 A * 8/1922 Schleifer ..... 19/217
1,694,432 A * 12/1928 Schleifer ..... 19/217
1,708,032 A * 4/1929 Schleifer ..... 19/217
1,715,473 A * 6/1929 Schleifer ..... 19/217
1,799,066 A * 3/1931 Schleifer ..... 19/217
2,044,460 A 6/1936 Bowerbank et al.
2,962,772 A 12/1960 Draving et al.
3,108,333 A * 10/1963 Schleifer ..... 19/235
4,270,245 A 6/1981 Stewart et al.
5,007,623 A 4/1991 Unkuri et al.

(Continued)

FOREIGN PATENT DOCUMENTS

DE 367482 C 1/1923

(Continued)

OTHER PUBLICATIONS

German Patent Office Search Report, dated Aug. 8, 2007, issued in related German Application No. 10 2006 050 384.8, and English language translation of Section C.

(Continued)

*Primary Examiner* — Shaun R Hurley
(74) *Attorney, Agent, or Firm* — Venable LLP; Robert Kinberg; Leigh D. Thelen

(57) ABSTRACT

In an apparatus for the fiber-sorting or fiber-selection of a fiber bundle comprising textile fibers, especially for combing, fiber is supplied by a supply device to a fiber-sorting device, especially a combing device. Clamping devices clamp the fiber bundle at a distance from its free end, and a mechanical device combs the free end to loosen and remove non-clamped constituents, for example, short fibers, neps, dust and the like. To increase productivity and obtain an improved combed sliver, downstream of the supply device there are at least two rotatably mounted rollers rotating rapidly without interruption, which are provided with the clamping devices, and measured value sensors for detecting values relating to the fibers or machine settings are connected to a control and regulation device, which is arranged to effect actions in dependence on the measured values.

25 Claims, 7 Drawing Sheets

U.S. PATENT DOCUMENTS

| | | | | |
|---|---|---|---|---|
| 5,343,686 | A | 9/1994 | Buchner et al. | |
| 5,404,619 | A * | 4/1995 | Jorg | 19/115 B |
| 5,457,851 | A | 10/1995 | Mondini | |
| 5,502,875 | A | 4/1996 | Stolz et al. | |
| 5,796,220 | A * | 8/1998 | Clapp et al. | 318/51 |
| 6,163,931 | A | 12/2000 | Leifeld | |
| 6,173,478 | B1 * | 1/2001 | Patelli et al. | 19/105 |
| 6,216,318 | B1 | 4/2001 | Leifeld | |
| 6,235,999 | B1 | 5/2001 | Rubenach | |
| 6,295,699 | B1 | 10/2001 | Temburg | |
| 6,499,194 | B1 * | 12/2002 | Gresser et al. | 19/239 |
| 6,611,994 | B2 * | 9/2003 | Bischofberger et al. | 19/98 |
| 7,173,207 | B2 * | 2/2007 | Losbrock et al. | 209/576 |
| 2002/0124354 | A1 | 9/2002 | Pferdmenges et al. | |
| 2003/0005551 | A1 | 1/2003 | Schurenkramer et al. | |
| 2003/0029003 | A1 | 2/2003 | Breuer et al. | |
| 2003/0070260 | A1 | 4/2003 | Rubenach | |
| 2003/0154572 | A1 | 8/2003 | Pferdmenges et al. | |
| 2004/0040121 | A1 | 3/2004 | Schmitz | |
| 2004/0128799 | A1 | 7/2004 | Hosel et al. | |
| 2005/0076476 | A1 | 4/2005 | Temburg | |
| 2005/0198783 | A1 | 9/2005 | Rubenach | |
| 2005/0278900 | A1 * | 12/2005 | Dammig | 19/239 |
| 2006/0260100 | A1 * | 11/2006 | Duda et al. | 19/236 |
| 2007/0180658 | A1 | 8/2007 | Saeger et al. | |
| 2007/0180659 | A1 | 8/2007 | Saeger et al. | |
| 2007/0180660 | A1 | 8/2007 | Saeger et al. | |
| 2007/0266528 | A1 * | 11/2007 | Farber et al. | 19/98 |
| 2008/0092339 | A1 | 4/2008 | Bossman et al. | |
| 2009/0000064 | A1 | 1/2009 | Saeger et al. | |
| 2009/0000065 | A1 | 1/2009 | Saeger et al. | |
| 2009/0000066 | A1 | 1/2009 | Saeger et al. | |
| 2009/0000067 | A1 | 1/2009 | Leder et al. | |
| 2009/0000069 | A1 | 1/2009 | Saeger et al. | |
| 2009/0000070 | A1 | 1/2009 | Saeger et al. | |
| 2009/0000071 | A1 | 1/2009 | Saeger et al. | |
| 2009/0000072 | A1 | 1/2009 | Saeger et al. | |
| 2009/0000073 | A1 | 1/2009 | Saeger et al. | |
| 2009/0000074 | A1 | 1/2009 | Bossmann | |
| 2009/0000075 | A1 | 1/2009 | Saeger et al. | |
| 2009/0000076 | A1 | 1/2009 | Bossmann et al. | |
| 2009/0000077 | A1 | 1/2009 | Saeger et al. | |
| 2009/0000078 | A1 | 1/2009 | Saeger et al. | |
| 2009/0000079 | A1 | 1/2009 | Bossmann | |

FOREIGN PATENT DOCUMENTS

| | | | |
|---|---|---|---|
| DE | 382169 | C | 9/1923 |
| DE | 399885 | C | 7/1924 |
| DE | 489 420 | C | 1/1930 |
| DE | 30 48 501 | A1 | 7/1982 |
| DE | 103 20 452 | A1 | 11/2004 |
| EP | 1 586 682 | A1 | 10/2005 |
| WO | WO-2006/012758 | A1 | 2/2006 |

OTHER PUBLICATIONS

German Patent Office Search Report dated Jul. 10, 2007, Issued in related German Patent Application No. 10 2006 050 453.4, and partial English-language translation.

U.S. Office Action dated Feb. 26, 2010, issued in related U.S. Appl. No. 12/149,506.

* cited by examiner

APPARATUS FOR THE FIBRE-SORTING OR FIBRE-SELECTION OF A FIBRE BUNDLE COMPRISING TEXTILE FIBRES, ESPECIALLY FOR COMBING

CROSS REFERENCE TO RELATED APPLICATIONS

This application claims priority from German Utility Model Application No. 20 2007 010 686.6 dated Jun. 29, 2007 and German Patent Application No. 10 2007 053 893.8 dated Nov. 9, 2007, the entire disclosure of each of which is incorporated herein by reference.

BACKGROUND OF THE INVENTION

The invention relates to an apparatus for the fibre-sorting or selection of a fibre bundle comprising textile fibres, especially for combing.

In a known apparatus, fibre bundles are supplied by means of supply means to a fibre-sorting device, especially to a combing device, in which clamping devices are provided, which clamp the fibre bundle at a distance from its free end and mechanical means are present which generate a combing action from the clamping site to the free end of the fibre bundle in order to loosen and remove non-clamped constituents, such as, for example, short fibres, neps, dust and the like from the free end, a take-off means is present to remove the combed fibre material and a plurality of drive devices is connected to a control device.

In practice, combing machines are used to free cotton fibres or woollen fibres of natural impurities contained therein and to parallelise the fibres of the fibre sliver. For that purpose, a previously prepared fibre bundle is clamped between the jaws of the nipper arrangement so that a certain sub-length of the fibres, known as the "fibre tuft", projects at the front of the jaws. By means of the combing segments of the rotating combing roller, which segments are filled with needle clothing or toothed clothing, this fibre tuft is combed and thus cleaned. The take-off device usually consists of two counter-rotating rollers, which grip the combed fibre tuft and carry it onwards. The known cotton-combing process is a discontinuous process. During a nipping operation, all assemblies and their drive means and gears are accelerated, decelerated and in some cases reversed again. High nip rates result in high acceleration. Particularly as a result of the kinematics of the nippers, the gear for the nipper movement and the gear for the pilgrim-step movement of the detaching rollers, high acceleration forces come into effect. The forces and stresses that arise increase as the nip rates increase. The known flat combing machine has reached a performance limit with its nip rates, which prevents productivity from being increased. Furthermore, the discontinuous mode of operation causes vibration in the entire machine, which generates dynamic alternating stresses.

EP 1 586 682 A discloses a combing machine in which, for example, eight combing heads operate simultaneously one next to the other. The drive of those combing heads is effected by means of a lateral drive means arranged next to the combing heads having a gear unit which is in driving connection by way of longitudinal shafts with the individual elements of the combing heads. The fibre slivers formed at the individual combing heads are transferred, one next to the other on a conveyor table, to a subsequent drafting system in which they are drafted and then combined to form a common combing machine sliver. The fibre sliver produced in the drafting system is then deposited in a can by means of a funnel wheel (coiler plate). The plurality of combing heads of the combing machine each have a feed device, a pivotally mounted, fixed-position nipper assembly, a rotatably mounted circular comb having a comb segment for combing out the fibre tuft supplied by the nipper assembly, a top comb and a fixed-position detaching device for detaching the combed-out fibre tuft from the nipper assembly. The lap ribbon supplied to the nipper assembly is here fed via a feed cylinder to a detaching roller pair. The fibre tuft protruding from the opened nipper passes onto the rearward end of a combed sliver web or fibre web, whereby it enters the clamping nip of the detaching rollers owing to the forward movement of the detaching rollers. The fibres that are not retained by the retaining force of the lap ribbon, or by the nipper, are detached from the composite of the lap ribbon. During this detaching operation, the fibre tuft is additionally pulled by the needles of a top comb. The top comb combs out the rear part of the detached fibre tuft and also holds back neps, impurities and the like. The top comb, for which in structural terms space is required between the movable nipper assembly and the movable detaching roller, has to be constantly cleaned by having air blown through it. For piercing into and removal from the fibre sliver, the top comb has to be driven. Finally, the cleaning effect at this site of jerky movement is sub-optimal. Owing to the differences in speed between the lap ribbon and the detaching speed of the detaching rollers, the detached fibre tuft is drawn out to a specific length. Following the detaching roller pair is a guide roller pair. During this detaching operation, the leading end of the detached or pulled off fibre bundle is overlapped or doubled with the trailing end of the fibre web. As soon as the detaching operation and the piecing operation have ended, the nipper returns to a rear position in which it is closed and presents the fibre tuft protruding from the nipper to a comb segment of a circular comb for combing out. Before the nipper assembly now returns to its front position again, the detaching rollers and the guide rollers perform a reversing movement, whereby the trailing end of the fibre web is moved backwards by a specific amount. This is required to achieve a necessary overlap for the piecing operation. In this way, a mechanical combing of the fibre material is effected. Disadvantages of that combing machine are especially the large amount of equipment required and the low hourly production rate. There are eight individual combing heads which have in total eight feed devices, eight fixed-position nipper assemblies, eight circular combs with comb segments, eight top combs and eight detaching devices. A particular problem is the discontinuous mode of operation of the combing heads. Additional disadvantages result from large mass accelerations and reversing movements, with the result that high operating speeds are not possible. Finally, the considerable amount of machine vibration results in irregularities in the deposition of the combed sliver. Moreover, the écartement, that is to say the distance between the nipper lip of the lower nipper plate and the clamping point of the detaching cylinder, is structurally and spatially limited. The rotational speed of the detaching rollers and the guide rollers, which convey the fibre bundles away, is matched to the upstream slow combing process and is limited by this. A further drawback is that each fibre bundle is clamped and conveyed by the detaching roller pair and subsequently by the guide roller pair. The clamping point changes constantly owing to the rotation of the detaching rollers and the guide rollers, i.e. there is a constant relative movement between the rollers effecting clamping and the fibre bundle. All fibre bundles have to pass through the one fixed-position detaching roller pair and the one fixed-position guide roller pair in succession, which represents a further considerable limitation of the production speed. The individual nipper assemblies are in drive connection with a crank mechanism with in each case an electric motor. The electric motors are connected by means of a control line to a control unit ST, via which the individual motors are controlled. In order to co-ordinate the electromotive drives with the drive of the circular comb, a sensor is provided, which is connected to the control unit via the line. The function of this sensor is to detect the particular angular position of the shaft of the circular comb and relay this to the control unit ST. It is thus possible to output appropriate control pulses to the relevant motors via the control unit ST, so that, on the one hand, the combing segment combs out the fibre tuft at a defined point in time and, on the other hand, the rotary movement of the detaching roller pair or the transport roller pair is matched to the nipper movement. Because several drive devices, which are controlled, are present for each combing head, the expenditure on equipment is particularly high. In addition, the apparatus is limited to the control of the drive devices.

SUMMARY OF THE INVENTION

It is an aim of the invention is therefore to provide an apparatus of the kind described at the beginning which avoids or mitigates the mentioned disadvantages and which in a simple way, in particular, enables the amount produced per hour (productivity) to be substantially increased and an improved combed sliver to be obtained.

The invention provides an apparatus for the fibre-sorting or fibre-selection of a fibre bundle comprising textile fibres having:

a fibre sorting device in which clamping devices are provided which each clamp a bundle of the textile fibres at a distance from its free end;

a supply device for supplying the fibre bundle to the fibre-sorting device;

at least one mechanical device for generating a combing action from the clamping site to the free end of the fibre bundle in order to loosen and remove non-clamped constituents;

a control and regulation device; and a plurality of drive devices connected to the control and regulation device;

wherein the fibre-sorting device comprises at least first and second rotatably mounted rollers that, in use, rotate rapidly without interruption, the clamping devices for the fibre bundles being distributed spaced apart in the region of the periphery of at least one said roller, and further comprises measured value sensors for detecting machine-related and technical values relating to the fibres, which sensors are in connection with the control and regulation device, the control and regulation device being capable of processing the measured values and emitting electrical signals to connected elements for performing in each case at least one function.

By implementing the functions of clamping and moving the fibre bundles to be combed-out on at least two rotating rollers, high operating speeds (nip rates) are achievable—unlike the known apparatus—without large mass accelerations and reversing movements. In particular, the mode of operation is continuous. When high-speed rollers are used, a very substantial increase in hourly production rate (productivity) is achievable which had previously not been considered possible in technical circles. A further advantage is that the rotary rotational movement of the rollers with the plurality of clamping devices leads to an unusually rapid supply of a plurality of fibre bundles per unit of time to the first roller, that is, preferably, a turning rotor, and to the second roller, that is, preferably, a combing rotor. In particular the high rotational speed of the rollers allows production to be substantially increased.

To form the fibre bundle (referred to herein also as "fibre tuft"), the fibre sliver pushed forward by the feed roller is clamped at one end by a clamping device and detached by the rotary movement of the turning rotor. The clamped end contains short fibres, the free region comprises the long fibres. The long fibres are pulled by separation force out of the fibre material clamped in the feed nip, short fibres remaining behind through the retaining force in the feed nip. Subsequently, as the fibre bundle is transferred from the turning rotor onto the combing rotor the ends of the fibre bundle are reversed: the clamping device on the combing rotor grips and clamps the end with the long fibres, so that the region with the short fibres projects from the clamping device and lies exposed and can thereby be combed out.

The fibre bundles are—unlike the known apparatus—held by a plurality of clamping devices and transported under rotation. The clamping point at the particular clamping devices therefore remains constant until the fibre bundles are transferred to the first or second roller. A relative movement between clamping device and fibre bundle does not begin until after the fibre bundle has been gripped by the first or second roller respectively and in addition clamping has been terminated. Because a plurality of clamping devices is available for the fibre bundles, in an especially advantageous manner fibre bundles can be supplied to the first and second roller respectively one after the other and in quick succession, without undesirable time delays resulting from just a single supply device. A particular advantage is that the supplied fibre bundles on the first roller (turning rotor) are continuously transported. The speed of the fibre bundle and of the co-operating clamping elements is the same. The clamping elements close and open during the movement in the direction of the transported fibre material. The at least one second roller (combing rotor) is arranged downstream of the at least one first roller (turning rotor). With the apparatus according to the invention, a substantially increased productivity is achievable. According to the invention, a regulation and control system for the rotor combing machine is present, which enables relevant process variables to the detected and evaluated. The actual values determined can be adapted to meet the required desired values. Furthermore, specific process parameters may be regulated in such a way that, for example, depending on production, optimum operating costs with constant product quality can be achieved, or for example, whilst the product quality remains the same, the production output can be increased. A further particular advantage is that a configuration of the process control that is optimally adapted to the process can be rendered possible through online-monitoring and data acquisition.

Further advantages of the invention may include one or more of, inter alia the following:

- Statistical data evaluation within a quality system is possible.
- Optimisation of the process as a whole and in respect of individual process variables is made possible. These are, for example, savings on raw material, reduction in operating costs, improvements in quality, machine settings adapted to the material.
- Possible variations from the desired values can be detected, and can be altered manually or by means of a control and regulation system.
- Detection and elimination of wrong settings and defective machine parts.

Evening-out of fluctuations in the process, e.g. feed fluctuations, by varying appropriate machine parameters.

In the case of individual drives, there are many possibilities for adjustment for that purpose.

In the case of a plurality of rotor combing units, for example, a double head rotor combing machine, for the production of a combed sliver the said measuring and regulation units can be transferred to the functional elements of the two combing units.

Variations between the combing units can be detected and evened out and a simultaneous run-down to empty of the material feed can be implemented.

The unit of time in which data acquisition is effected can be fixed as desired, and values can be determined at different time intervals.

Maintenance management, in particular clothing management, is facilitated.

Avoidance of fibre damage (force measurements).

In accordance with the invention measured value sensors for detecting machine-related and technical values relating to the fibres are in connection with the control and regulation device, which is capable of processing the measured values and emitting electrical signals to connected elements for performing in each case at least one function. The connected elements may be components of the fibre-sorting device, especially rotor combing device, and/or they may comprise components of devices upstream or downstream of the combing device, for example, of a feed device for feeding fibre material to the rotor combing device or of a drafting device arranged downstream of the rotor combing device.

The connected elements may comprise, for example, one or more elements selected from actuators, display devices, operating devices, and monitoring devices.

In some embodiments, the measured value sensors are connected to an analogue-digital converter, which is in connection with the electronic control and regulation device. Advantageously, the electronic control and regulation device contains a microprocessor with a memory.

If desired, a setpoint device may be associated with the electronic control and regulation device. In a preferred arrangement, the electronic control and regulation device is connected to the digital-analogue power converter, which is in connection with actuators. Advantageously, the analogue-digital converter is controllable by the electronic control and regulation device.

In certain embodiments, signals of the actual value of the measured value sensor are arranged to be input into the data memory of the microcomputer. It is preferred that, also, additional functions for internal and external control processes are arranged to be input into the data memory.

If desired, the fibre material thickness, that is the CV value, is measurable in the feed unit, for example, between feed trough and feed roller. For that purpose, a displacement sensor, distance measuring device or the like is arranged on the biased feed trough. Where the material feed is a wound lap feed, the fibre material thickness, or rather the CV value, may be determinable through taking the difference in the feed weight between two points in time, for example, using scales. Where the material feed is a sliver feed, the fibre material thickness, or rather the CV-value, may be determinable with a measured value sensor at the sliver intake, for example, a measuring funnel, a microwave element or the like.

In certain embodiments, as control variable, the material feed, for example, feed amount, is alterable. As well or instead, an alteration in the overall draft, for example, through change of the draft between piecing roller and web take-off, is used as control variable. When using a drafting system with levelling, an alteration of the drafting system draft may be used as control variable.

In other embodiments a calculation of the comber waste percentage is carried out from the determination of the input mass and the output mass. By way of example, the signal upstream of the drafting system may be used to determine the output mass in the case of a drafting with levelling.

In the case of a drafting system without levelling, the combed sliver mass, for example, may be used to determine the output mass. The determination of the comber waste percentage may be effected, for example, using mass flow measurement of the discharged comber waste. In some embodiments, the adjustment of the ecartement (turning rotor to combing rotor distance) may be used as control variable for changing the comber waste percentage. In other embodiments, a variation in the setting of the combing device (for example, spacing of the combs, surface of the combs, clothing angle) may be used as control variable for changing the comber waste percentage. In yet further embodiments, a variation of the feed amount may be used as control variable for changing the comber waste percentage. In another embodiment, a variation in the detaching distance between feed device and turning rotor may be used as control variable for changing the comber waste percentage.

In certain embodiments, the clamping forces of the feed tray are determinable. In that case, the nip geometry of the feed trough may be alterable for changing the clamping forces of the feed trough. As well or instead, the tray loading, for example, spring, may be variable for changing the clamping forces of the feed tray.

In some embodiments, the separation force on separation of the feed bundle from the material feed by the nippers of the turning rotor is determinable, for example, by means of torque sensing or tension sensing. Advantageously, the nip rate or the production speed is adjustable as the control variable for changing the separation force, for example, reduction in the nip rate when a maximum separation force is exceeded. Advantageously, to achieve a desired separation force, an adaptation of the feed amount and/or of the distance of the turning rotor from the feed unit is usable as control variable for changing the separation force.

In certain embodiments, a determination of the educed pressures in the turning rotor and/or in the combing rotor, in the piecing roller, in the feed roller, if present, and/or in the combing elements may be effected, for example, by means of pressure sensors. Advantageously, a specific adaptation of the set reduced pressures, for example, adapted to the material, to the production output, to the nip rate etc. is carried out as control variable based on the reduced pressure measurements.

In some embodiments, a determination of the jetting pressures, for example, during fibre bundle feed to the turning rotor, during assisted feed bundle separation, is effected for optimum material feed to the combing elements, for separation of the web from the piecing roller or the like. Advantageously, a specific adaptation of the set pressures, for example, adapted to the material, to the production output, to the nip rate etc. is carried out as control variables based on the measurement of the jetting pressure.

In certain embodiments, a measurement of the forces that occur during combing of the material is effected. An adaptation of the production speed depending on the combing forces ascertained may, if desired, be used as control variable for changing the combing forces. In other embodiments, a variation of the relative speed of the combing elements with respect to the combing rotor may be used as control variable for changing the combing forces.

In yet further embodiments, a variation of the comb surface, for example, clothing or clothing angle, my be used as control variable for changing the combing forces. In other embodiments, a variation of the spacings of combing rotor (with clamped fibre bundle) and combing device may be used as control variable for changing the combing forces.

In some embodiments of the invention, an on-line measurement of the neps, bits of seed husk and other unwanted particles in the web, for example, on the piecing roller or in the region adjoining the piecing roller, is effected. In certain such embodiments, a change in the settings of the combing device (spacing of the combs, surface of the combs, relative speed of the combing elements with respect to the combing rotor etc.) may be used as control variable for changing the neps, bits of seed husk and unwanted particle values. In other such embodiments, a variation in the production speed may be used as control variable for changing the neps, bits of seed husk and unwanted particle values. In yet further such embodiments, a change in the comber waster percentage, for example, through ecartement and feed amount adjustment, may be used as control variable for changing the neps, bits of seed husk and unwanted particle values.

In certain preferred embodiments, a measurement of the CV values of the combed sliver may be effected. In some such embodiments, a variation in the feed amount may be used as control variable for changing the combed sliver CV value. In other such embodiments, a variation in the take-off speed may be effected as control variable for changing the combed sliver CV values. In yet further such embodiments, a variation of the overall draft, for example, by changing the draft between piecing roller and web take-off, or, when using a drafting system with levelling, by varying the drafting system draft, may be effected as control variable for changing the combed sliver CV values. If desired, during start-up and shut-down of the machine, for example, during lap change-over or after sliver breakage, the drafts may be adjustable as control variable for changing the combed sliver CV values. In certain other embodiments, a variation of the degree of overlap on transfer of the fibre bundles from the combing rotor to the piecing roller may be effected as control variable for changing the combed sliver CV values. In yet further embodiments, a variation between same-direction and counter-direction piecing may be effected as control variable for changing the combed sliver CV-values.

In certain embodiments, a sliver-monitoring/sliver breakage monitoring of the output material may be effected. In that case, it is advantageous that, by virtue of the sliver breakage monitoring facility, a machine stop can be effected in the event of sliver breakage.

In some embodiments, distance measurements of specific elements with respect to one another, for example, between combing rotor and turning rotor, between the combing device and the combing rotor, between the piecing roller and the combing rotor, between the feed roller and the turning rotor, may be effected. In those embodiments, as control variables based on the distance measurements, elements, for example, the combing device, the piecing roller, the combing rotor and the feed roller, may be automatically adjustable by a predetermined amount.

Preferably, the first roller is a turning rotor and the second roller is a combing rotor. Preferably, the directions of rotation of the turning rotor and the combing rotor are opposed.

In certain embodiments, for the suction of the supplied bundles, at least one suction device is associated with the clamping devices in the region of the take-up of the fibre bundle from the supply device to the first roller and/or in the region of the transfer of the fibre material from the first roller to the second roller.

The invention also provides an apparatus for the fibre-sorting or fibre-selection of a fibre bundle comprising textile fibres, especially for combing, which is supplied by means of supply means to a fibre-sorting device, especially a combing device, in which clamping devices are provided which clamp the fibre bundle at a distance from its free end, and mechanical means are present which generate a combing action from the clamping site to the free end of the fibre bundle in order to loosen and remove non-clamped constituents, such as, for example, short fibres, neps, dust and the like from the free end, a take-off means is present to remove the combed fibre material and a plurality of drive devices are connected to a control device, characterised in that downstream of the supply means there are arranged at least two rotatably mounted rollers which are provided with clamping devices for the fibre bundle, which clamping devices are distributed spaced apart in the region of their periphery, and measured value sensors for detecting machine-related and technical values relating to the fibres are in connection with the control and regulation device, which is capable of processing the measured values and emitting electrical signals to connected elements for performing in each case at least one function.

DETAILED DESCRIPTION OF CERTAIN PREFERRED EMBODIMENTS

Figure 1:
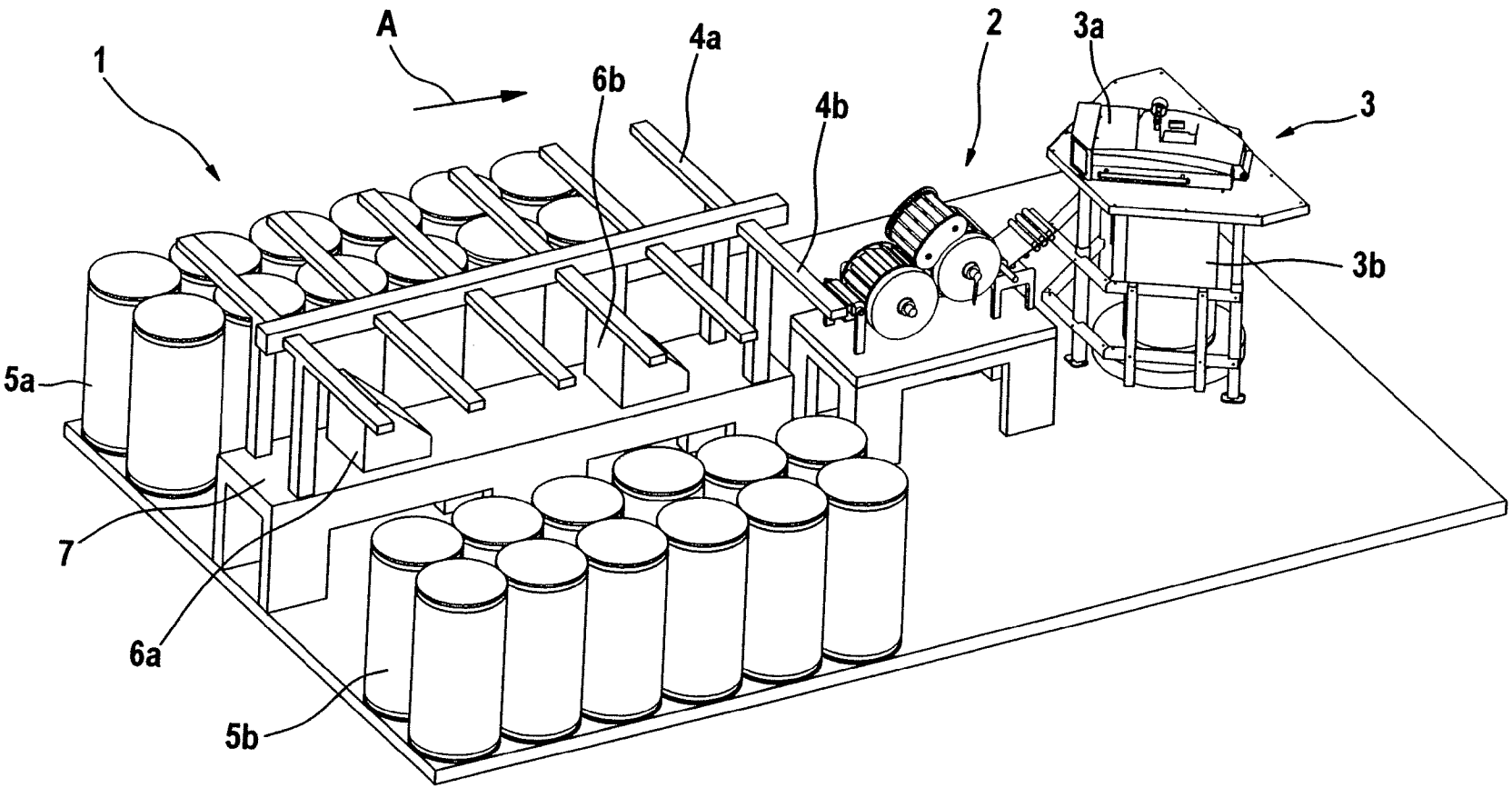
FIG. 1 is a diagrammatic perspective view of a device for combing fibre material, comprising a combing preparation device, a rotor combing machine and a sliver-deposition device.

With reference to FIG. 1, a combing preparation machine 1 has a sliver-fed and lap-delivering spinning room machine and two feed tables 4*a*, 4*b* (creels) arranged parallel to one another, there being arranged below each of the feed tables 4*a*, 4*b* two rows of cans 5*a*, 5*b* containing fibre slivers (not shown). The fibre slivers withdrawn from the cans 5*a*, 5*b* pass, after a change of direction, into two drafting systems 6*a*, 6*b* of the combing preparation machine 1, which are arranged one after the other. From the drafting system 6*a*, the fibre sliver web that has been formed is guided over the web table 7 and, at the outlet of the drafting system 6*b*, laid one over the other and brought together with the fibre sliver web produced therein. By means of the drafting systems 6*a* and 6*b*, in each case a plurality of fibre slivers are combined to form a lap and drafted together. A plurality of drafted laps (two laps in the example shown) are doubled by being placed one on top of the other. The lap so formed is introduced directly into the supply device (feed element) of the downstream rotor combing machine 2. The flow of fibre material is not interrupted. The combed fibre web is delivered at the outlet of the rotor combing machine 2, passes through a funnel, forming a comber sliver, and is deposited in a downstream sliver-deposition device 3. Reference numeral A denotes the operating direction.

An autoleveller drafting system 50 (see FIG. 2) can be arranged between the rotor combing machine 2 and the sliver-deposition device 3. The comber sliver is thereby drafted.

In accordance with a further construction, more than one rotor combing machine 2 is provided. If, for example, two rotor combing machines are present, then the two delivered comber slivers 17 can pass together through the downstream autoleveller drafting system 50 and be deposited as one drafted comber sliver in the sliver-deposition device 3.

The sliver-deposition device 3 comprises a rotating coiler head 3*a*, by which the comber sliver can be deposited in a can 3*b* or (not shown) in the form of a can-less fibre sliver package.

Figure 2:
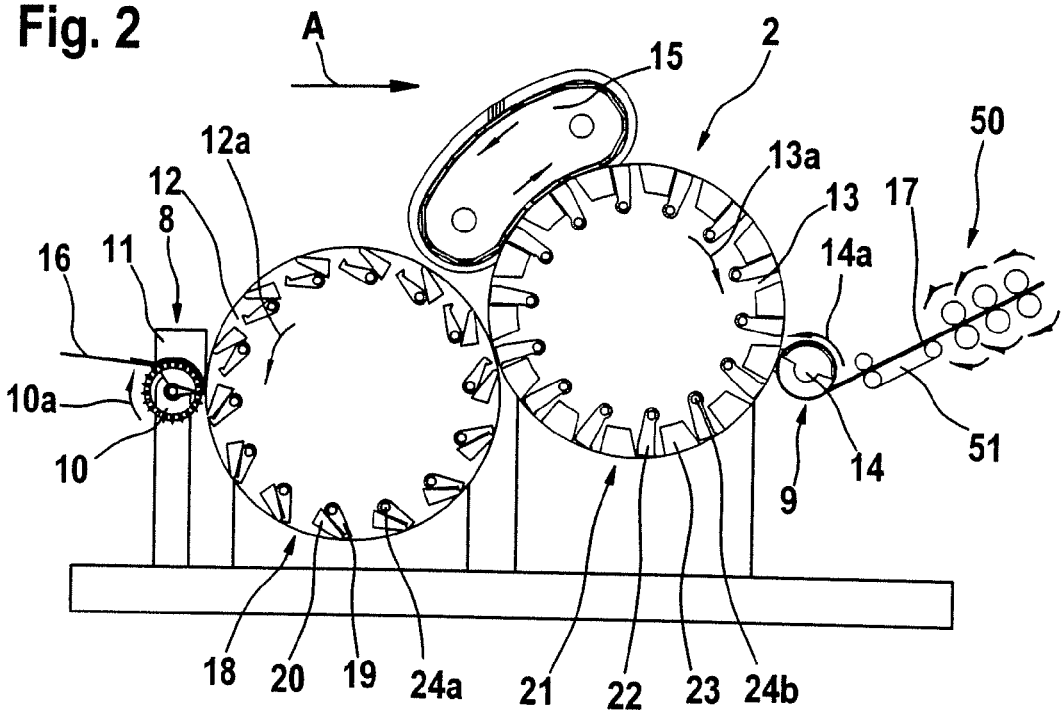
FIG. 2 is a diagrammatic side view of a rotor combing machine according to the invention having two rollers.

FIG. 2 shows one form of rotor combing machine suitable for incorporating a control arrangement in accordance with the invention. The rotor combing machine 2 has a supply device 8 comprising a feed roller 10 and a feed tray 11, has a first roller 12 (turning rotor), second roller 13 (combing rotor), a take-off device 9 comprising a take-off roller 14 and a revolving card top combing assembly 15. The directions of rotation of the rollers 10, 12, 13 and 14 are shown by curved arrows 10*a*, 12*a*, 13*a* and 14*a*, respectively. The incoming fibre lap is indicated by reference numeral 16 and the delivered fibre web is indicated by reference numeral 17. The rollers 10, 12, 13 and 14 are arranged one after the other. Arrow A denotes the operating direction.

The first roller 12 is provided in the region of its outer periphery with a plurality of first clamping devices 18 which extend across the width of the roller 12 (see FIG. 3) and each consist of an upper nipper 19 (gripping element) and a lower nipper 20 (counter-element). In its one end region facing the centre point or the pivot axis of the roller 12, each upper nipper 19 is rotatably mounted on a pivot bearing 24*a*, which is attached to the roller 12. The lower nipper 20 is mounted on the roller 12 so as to be either fixed or movable. The free end of the upper nipper 19 faces the periphery of the roller 12. The upper nipper 19 and the lower nipper 20 co-operate so that they are able to grip a fibre bundle 16 (clamping) and release it.

The second roller 13 is provided in the region of its outer periphery with a plurality of two-part clamping devices 21, which extend across the width of the roller 13 (see FIG. 3) and each consist of an upper nipper 22 (gripping element) and a lower nipper 23 (counter-element). In its one end region facing the centre point or the pivot axis of the roller 13, each upper nipper 22 is rotatably mounted on a pivot bearing 24*b*, which is attached to the roller 13. The lower nipper 23 is mounted on the roller 13 so as to be either fixed or movable. The free end of the upper nipper 22 faces the periphery of the roller 13. The upper nipper 22 and the lower nipper 23 co-operate so that they are able to grip a fibre bundle (clamping) and release it. In the case of roller 12, around the roller periphery between the feed roller 10 and the second roller 13 the clamping devices 18 are closed (they clamp fibre bundles (not shown) at one end) and between the second roller 13 and the feed roller 10 the clamping devices 18 are open. In roller 13, around the roller periphery between the first roller 12 and the doffer 14 the clamping devices 21 are closed (they clamp fibre bundles (not shown) at one end) and between the doffer 14 and the first roller 12 the clamping devices 21 are open. Reference numeral 50 denotes a drafting system, for example an autoleveller drafting system. The drafting system 50 is advantageously arranged above the coiler head 3*a*. Reference numeral 51 denotes a driven ascending conveyor, for example a conveyor belt. It is also possible to use an upwardly inclined metal sheet or the like for conveying purposes.

Figure 3:
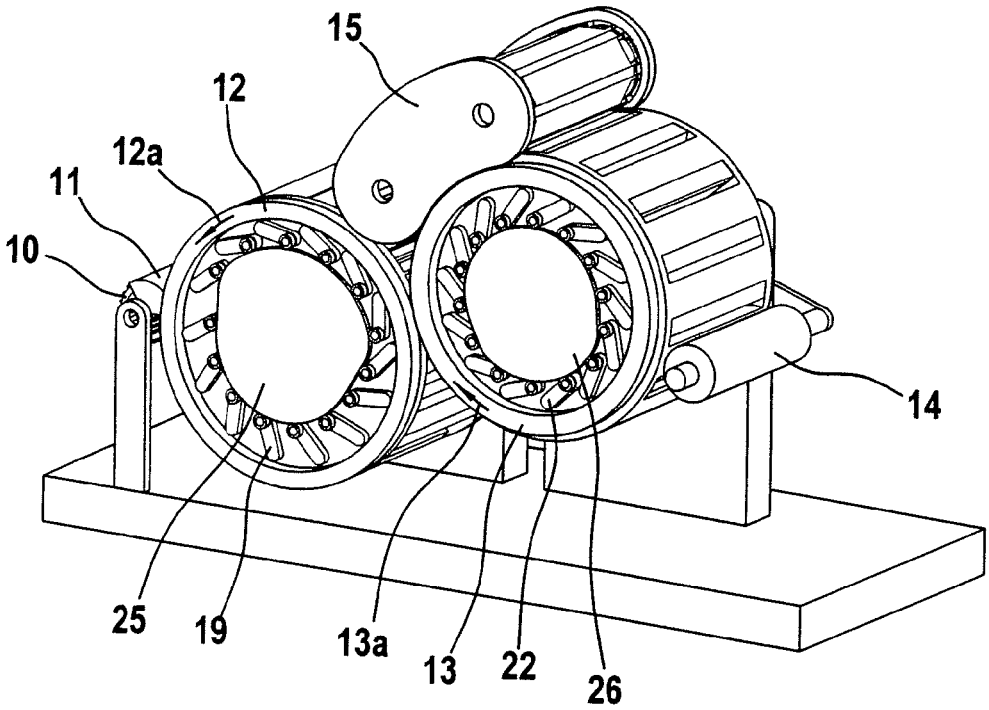
FIG. 3 is a perspective view of the rotor combing machine substantially according to FIG. 2 having two cam discs.

In an arrangement according to FIG. 3, two fixed cam discs 25 and 26 are provided, about which the roller 12 having the first clamping devices 18 and the roller 13 having the second clamping device 21 are rotated in the direction of arrows 12*a* and 13*a*, respectively. The loaded upper nippers 19 and 22 are arranged in the intermediate space between the outer periphery of the cam discs 25, 26 and the inner cylindrical surfaces of the rollers 12, 13. By rotation of the rollers 12 and 13 about the cam discs 25 and 26 respectively, the upper nippers 19 and 22 are rotated about pivot axes 24*a* and 24*b*, respectively. In that way, the opening and closing of the first clamping devices 18 and the second clamping devices 21 is implemented.

Figure 4:
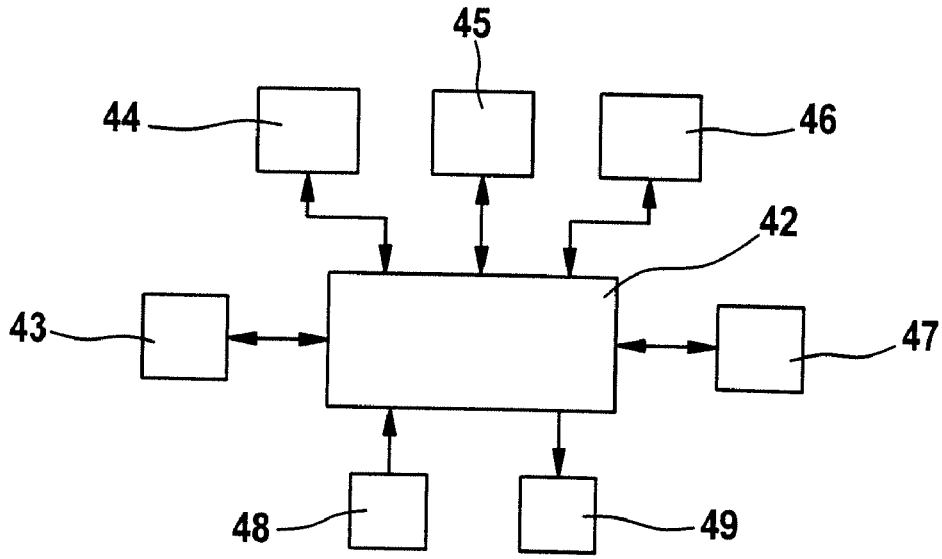
FIG. 4 is a block circuit diagram showing an electronic control and regulation device for the combing preparation device, the rotor combing machine and the sliver-deposition device of FIG. 1.

According to FIG. 4, an electronic control and regulation device 42 (machine and system control means), for example a microcomputer with a microprocessor, is provided, to which inter alia the drive devices 43, 44, 45, 46, 47, for example electric motors for the rollers 10, 12, 13, 14 and for the revolving card top assembly 15 of the rotor combing machine 2, are connected. Reference numeral 48 denotes an input device and reference numeral 49 denotes a display device. The drive devices for the combing preparation machine 1, the drafting system 50, the conveyor belt 51 and for the sliver-deposition device 3, are advantageously also connected (not shown).

Insofar as the rollers 12 and 13 are driven by means of a common gear, the drive motor for the common gear is connected to the control and regulation device 42.

The circumferential speeds are, for example, for the feed roller about from 0.2 to 1.0 m/sec; the first roller 12 about from 2.0 to 6.0 m/sec; the second roller 13 about from 2.0 to 6.0 m/sec; the doffer about from 0.4 to 1.5 m/sec; and the revolving card top assembly about from 1.5 to 4.5 m/sec. The diameter of the first roller 12 and the second roller 13 is, for example, about from 0.3 m to 0.8 m.

In respect of the mode of operation and operating sequence of the apparatus according to the invention:

Lap Preparation

A plurality of slivers are combined to form a lap 16 and drafted together. A plurality of laps 16 can be doubled by being placed one on top of the other. The resulting lap 16 is introduced directly into the feed element 10 of the rotor combing machine 2. The flow of material is not interrupted by forming a wound lap.

Feed

Unlike a flat combing machine, the upstream lap 16 is fed continuously by means of a conveyor element. The feed quantity is determined by the length of lap 16 conveyed between two closure time points of the nippers 18 (reversing nippers) of the first rotor 12 (turning rotor).

Clamping 1

The fibre tuft aligned and projecting out of the lap 16 is clamped by a clamping device 18 (reversing nipper) of the first rotor 12 (turning rotor). The clamping device 18 of the first rotor 12 assumes the function of detachment.

Removal

As a result of the rotation of the turning rotor 12 with the reversing nippers 18 located thereon, the clamped fibre tuft is removed from the feed lap, it being necessary for a retaining force to act on the lap 16 so that the fibres in the lap 16 not clamped by the reversing nipper 8 are retained. The retaining force is applied by the conveyor element of the feed means or by additional means such as a feed tray or a top comb. The elements that generate the retaining force assume the function of the top comb.

Clamping 2

The fibre tuft is aligned and transferred to the clamping device 21 (combing nipper) of the second rotor 13 (combing rotor). The distance between the reversing nipper clamping line and the combing nipper clamping line at the time the combing device 21 closes determines the ecartement.

Combing

The fibre tuft projecting out of the combing nipper 21 contains non-clamped fibres that are eliminated by means of combing.

Piecing

The combed-out fibre tuft is deposited on a take-off roller 14. The surface of the take-off roller 14, which surface is acted upon by suction and is air-permeable, causes the fibre tuft to be deposited, stretched-out, on the take-off roller 14. The fibre tufts are placed one on top of the other, overlapping in the manner of roof tiles, and form a web of fibre portions.

Web Removal and Comber Sliver Formation

The web 17 is removed from the take-off roller 14 at a point on the take-off roller not acted upon by suction and is guided into a funnel 39.

Comber Sliver Procedure

The resulting comber sliver can be doubled and drafted (drafting system 50) and is then deposited, for example, in a can 3*b* by means of coiler 3*a*.

Figure 5:
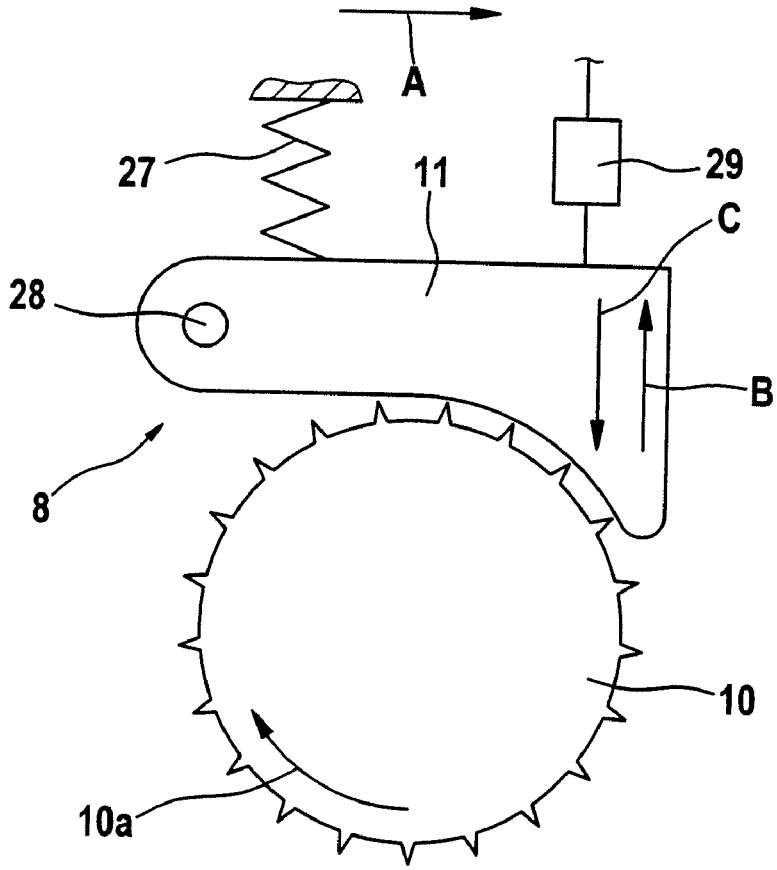
FIG. 5 shows a feed device for use in the apparatus of the invention, comprising feed roller and spring-loaded feed tray, with which a displacement sensor is associated.

According to FIG. 5, the feed device 8 comprises a slow-speed feed roller 10 rotating in direction 10*a*, and a feed tray 11 loaded by a spring 27. The feed tray 11 is mounted so as to rotate about a fixed-position bearing 28 and is movable in the direction of the arrows B, C. Associated with the feed tray 11 is a measuring element for the displacement (displacement sensor 29), for example, an inductive displacement sensor, proximity switch or the like. In this way, it is possible to detect the CV value of the fibre material feed by ascertaining the lap thickness between feed tray 11 and feed roller 10, for example, by means of the displacement sensor 29.

Figure 6:
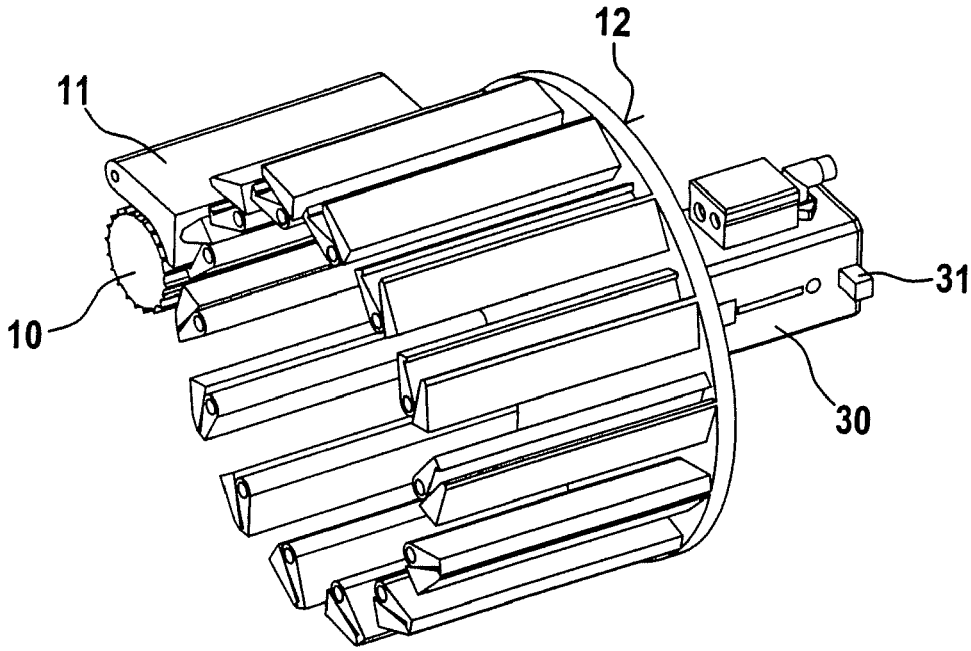
FIG. 6 shows a turning rotor with a drive unit, with which a torque sensor is associated.

In accordance with FIG. 6, a torque sensor 31 for the turning rotor 12 is associated with the drive element 30, for example, a drive motor. In this way, determination of the separation force on separation of the feed tuft from the material feed by the nippers 19, 20 of the turning rotor 12 is implemented by means of torque sensing.

Figure 7:
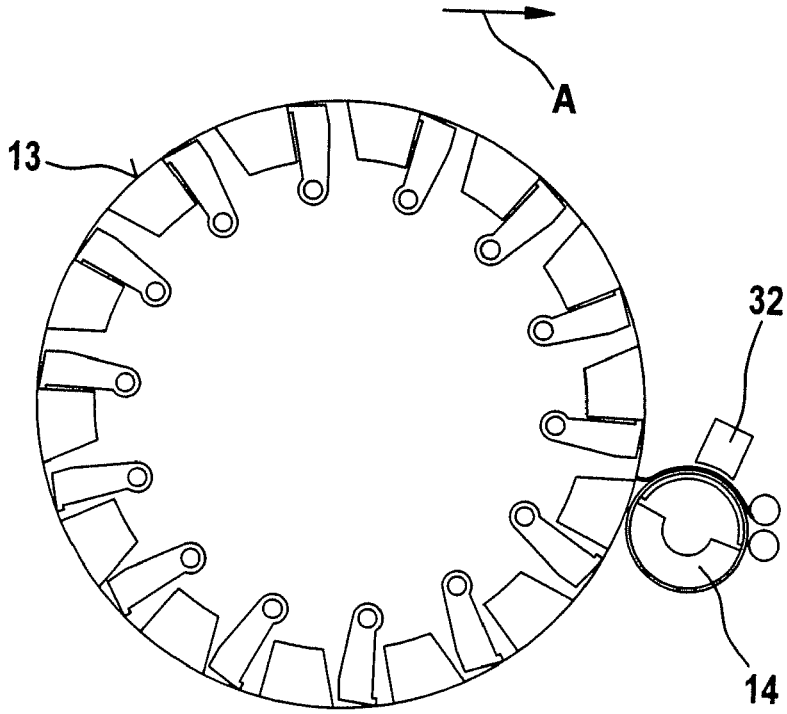
FIG. 7 shows a measuring element on a piecing roller for online measurement of neps, bits of seed husk and other unwanted particles in the combed fibre web on the piecing roller.

According to FIG. 7, a sensor 32, for example, corresponding to EP 0 738 792 A, is associated with the piecing roller 14, or rather with the combed fibre material on the piecing roller 14. An on-line measurement of the neps, bits of seed husk and other unwanted particles in the web on the piecing roller 14 is thereby possible.

Figure 8:
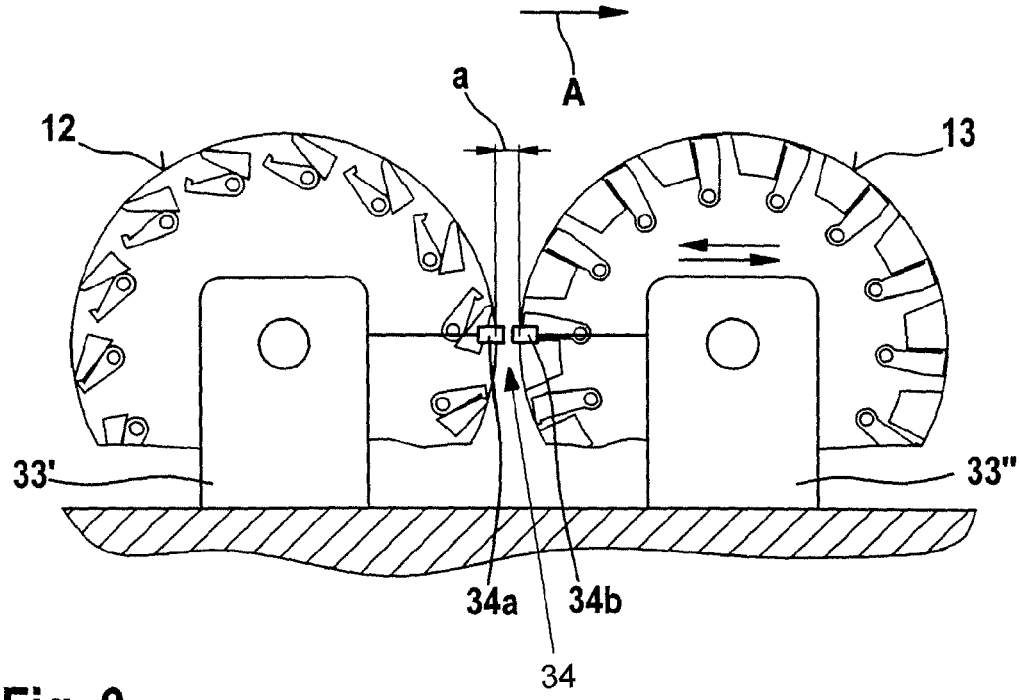
FIG. 8 shows a distance sensor for measuring the distance a between a turning rotor and a combing rotor.

According to FIG. 8, a displacement sensor 34, for example, an inductive proximity initiator comprising two parts 34*a*, 34*b*, is associated with the bearing elements 33', 33" for the turning rotor 12 and the combing rotor 13. In this way, a distance measurement (distance a) between combing rotor 13 and turning rotor 12 is possible. The distance sensor 34 is electrically connected to a regulation and control device 42 (see FIG. 9).

Figure 9:
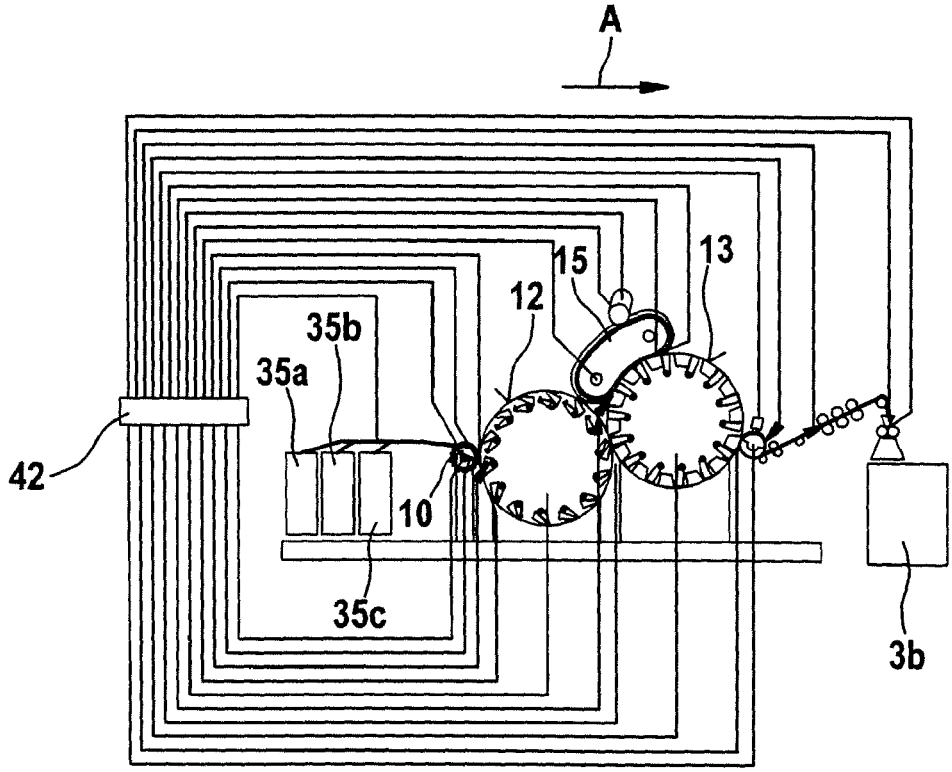
FIG. 9 shows a rotor combing machine generally according to FIG. 2 with sliver feed and measuring and actuating devices which are connected to a regulation and control device.

FIG. 9 shows diagrammatically the rotor combing machine with measuring elements and actuators, which are connected to a regulation and control unit 42, for example, a microcomputer with microprocessor. A sliver feed is provided, which is supplied from cans 35*a*, 35*b*, 35*c* to the feed roller 10.

Figure 10:
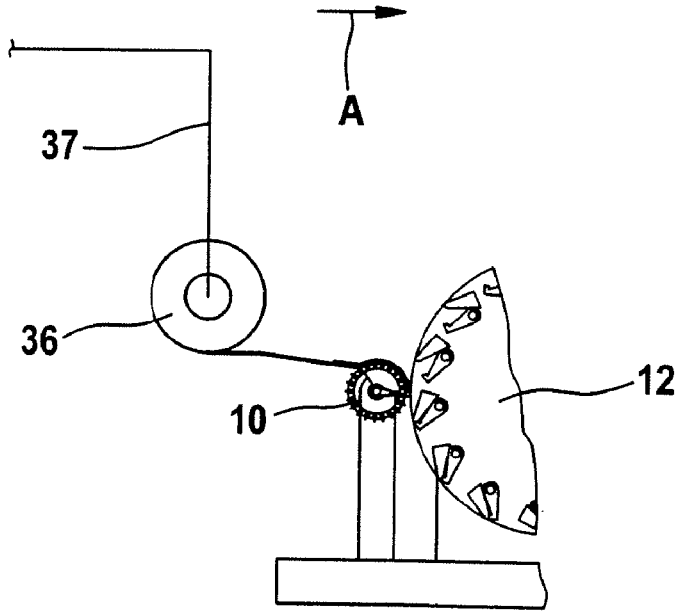
FIG. 10 shows a wound lap feed of a rotor combing machine generally according to FIG. 2.

According to FIG. 10, in contrast with FIG. 9, a feed with a wound lap 36 is effected, from which the fibre material is supplied to the feed roller 10. The drive device (not shown) for the wound lap device is connected via a control line 37 to the regulation and control unit 42 (see FIG. 9).

Figure 11:
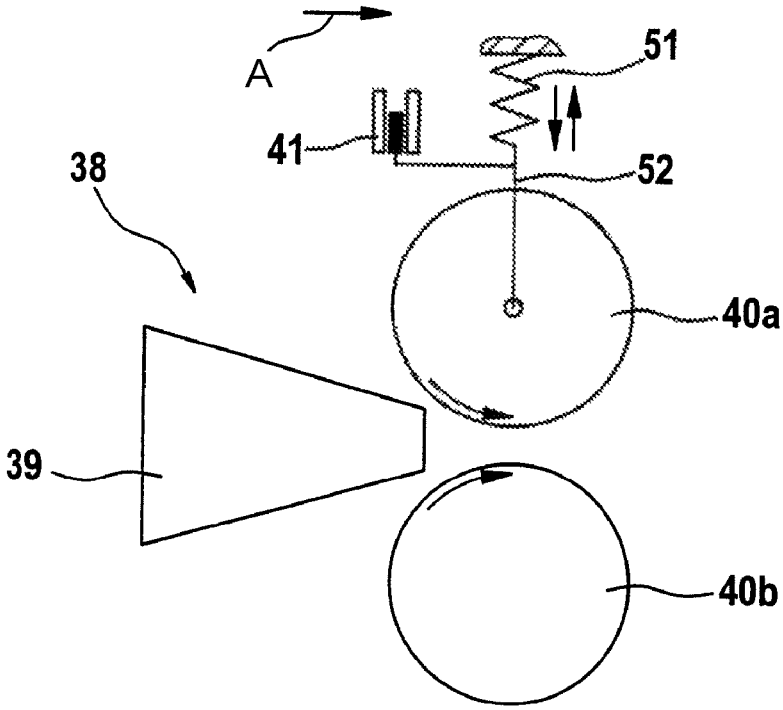
FIG. 11 shows a sliver-forming unit with measuring device for the thickness of the combed fibre material.
Figure 12:
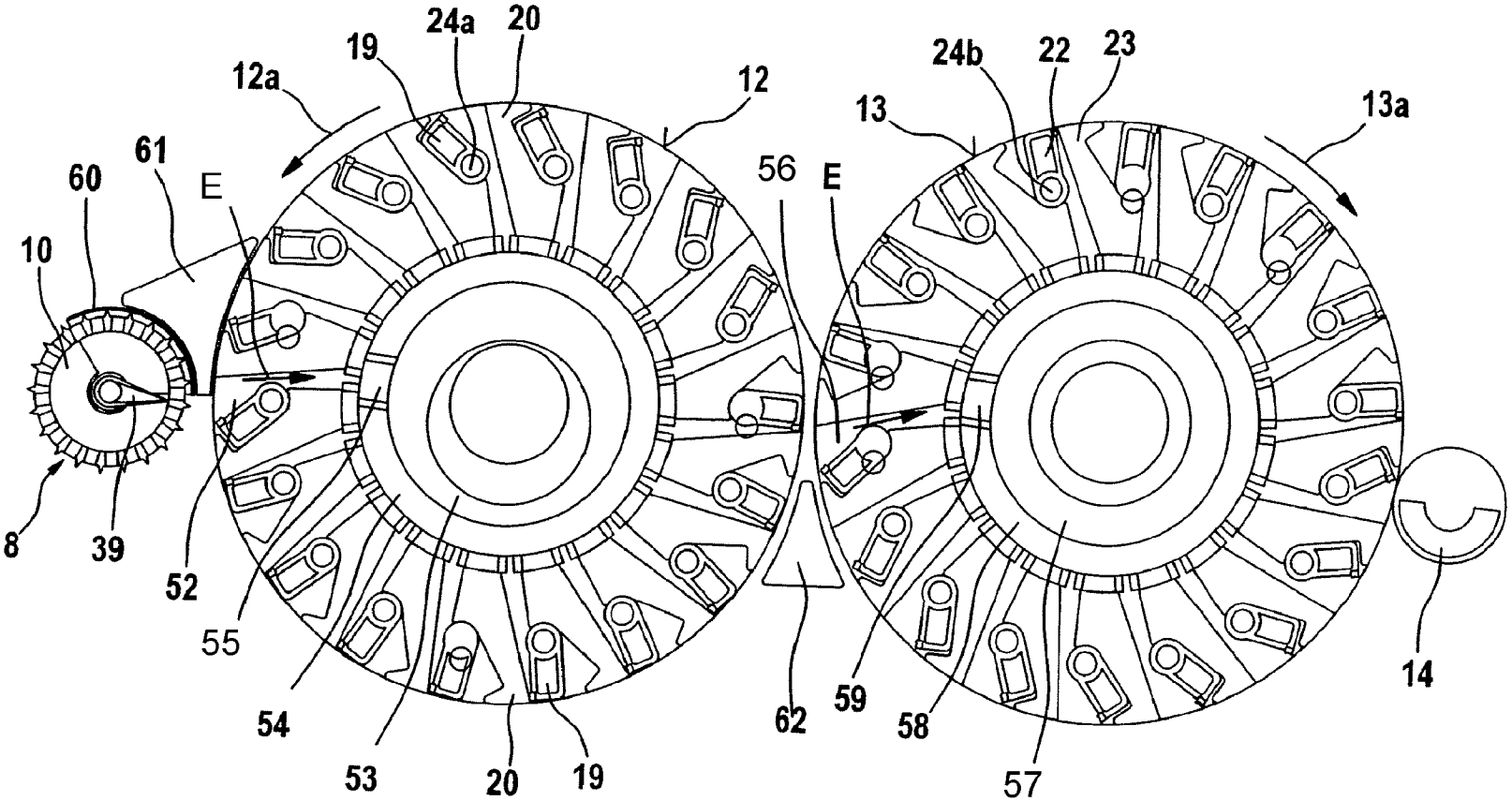
FIG. 12 shows a rotor combing machine generally similar to that in FIG. 2, but in which suction devices are associated with the clamping devices.

In accordance with FIG. 11, a sliver-forming unit 38, which comprises a fibre sliver funnel 39 and two delivery rollers 40*a*, 40*b*, is disposed downstream of the piecing roller 14 (see FIG. 12). The delivery roller 40*a* is deflectable under loading by a spring 51. A displacement sensor 41, for example, an inductive displacement sensor, which is connected via a control unit 43 to the regulation and control device 42, is associated with the support element 52 for the delivery roller 40*a*. In this way, the thickness of the combed fibre material (not illustrated) is determined.

Certain examples of measured and control variables, and of measuring elements and actuators, are set out below by way of illustration only. It will be appreciated that other arrangements are possible.

Measured and Control Variables (and Measuring Elements and Actuators)

- Monitoring of incoming material. Wound lap monitoring respectively individual sliver monitoring where sliver feed and sliver breakage is involved, and monitoring for wound lap run-down to empty and can run-down to empty respectively. Wound lap run-down to empty is determined, for example, using the reflection of a light beam or using the difference in the wound lap weight to wound lap-wood weight by means of weighing.

Control Variables in Respect of Monitoring the Feed Material:

- Machine stop in absence of material feed.
- Rotor combing machine comprises two assemblies. With different residual weights on the winding tubes and individual drive of the combing heads, it is possible, for example, to implement simultaneous run-down to empty of the wound laps by means of different production speeds, and consequently carry out a block change-over combined with automatic lap change.
- Determination of CV value of the material feed by ascertaining lap thickness in the feed unit, for example, between feed tray 11 and feed roller 12, for example, by means of displacement sensors (FIG. 4) or, in the case of wound lap feed, by means of the difference in feed weight between time A and time B. In the case of sliver feed, determination of the CV value can be carried out with measuring devices at the sliver intake, for example, measuring funnels, or using microwaves.

Control Variables in Respect of CV Value Variations In the Material Feed:

- Variation of the feed amount.
- Variation of the overall draft, for example, by changing the draft between piecing roller 14 and web take-off, and, when using a drafting system with levelling 50, by varying the drafting system draft.

Determination of the input mass and the output mass and through this calculation of the comber waste percentage. The input mass can be ascertained by measuring the lap thickness, for example, between feed tray 11 and feed unit 10, and by determining the lap weight in the feed unit. In the case of sliver feed, measurement of the input mass can alternatively be carried out with measuring devices at the sliver intake, for example, measuring funnels, or by means of microwaves. To determine the output mass, in the case of a drafting with levelling the signal upstream of the drafting system 50 is recorded, and in the case of drafting system without levelling, for example, the combed sliver mass is recorded.

Determination of the comber waste percentage using mass flow measurement of the discharged comber waste.

Control Variables for Changing the Comber Waster Percentage:

Adjustment of the écartement (distance between turning rotor 12 and combing rotor 13) (see FIG. 8).

Variation of the setting of the combing device 15 (for example, spacing of the combs, surface of the combs, clothing angle).

Variation of the feed amount.

Variation of the detaching distance between feed device 8 and turning rotor 12.

Determination of the clamping forces of the feed tray 11.

Control Variables for Changing the Clamping Forces of The Feed Tray 11:

Change nip geometry of the feed tray 11,

Vary tray loading.

Determination, for example, by means of torque sensing (FIG. 6) or tension sensing, of the separation force on separation of the feed tuft from the material feed by the nippers of the turning rotor 12.

Control Variables for Changing the Separation Force:

Adapt nip rate, production speed (for example, by reducing the nip rate when a maximum separation force is exceeded).

Adaptation of the feed amount or the distance of the turning rotor 12 from the feed unit 8 to achieve a desired separation force.

Determination of the reduced pressures in the turning rotor 12, in the combing rotor, in the piecing roller, in the feed roller if present, in the combing elements etc., for example, by means of pressure sensors (see FIG. 12 on this point).

Control Variables Based on Reduced Pressure Measurements:

Specific adaptation of the set reduced pressures, for example, adapted to the material, to the production output, to the nip rate etc. The result is a reduction in operating costs, and a reduced pressure setting adapted in the best possible manner to the material.

Determination of the jetting pressures, for example, during tuft feed to the turning rotor 12, during assisted feed tuft separation, for optimum material feed to the combing elements, for separation of the web from the piecing roller 14 etc.

Control Variables Based on Measurement of the Air Jetting Pressure:

Specific adjustment of the set pressures, for example, adapted to the material, to the production output, to the nip rate etc. This results in a reduction in operating costs and a jetting pressure setting adapted in the best possible manner to the material.

Measurement of the forces that occur during combing of the material.

Control Variables for Changing the Combing Forces:

Adaptation of the production speed depending on the combing forces ascertained.

Variation of the relative speed of the combing elements 15 with respect to the combing rotor 13.

Variation of the comb surface, e.g. clothing or clothing angle.

Variation of the spacings of combing rotor 12 (with clamped fibre tuft) and combing device 15.

On-line measurement of the neps, bits of seed husk and other unwanted particles in the web (corresponding, for example, to the measuring system Nepcontrol CT: NCT), for example, on the piecing roller 14 (FIG. 7) or in the region adjoining the piecing roller 14.

Control Variables for Changing the Values for Neps, Bits of Seed Husk and Unwanted Particles:

Change of the settings of the combing device 15 (spacing of the combs, surface of the combs, relative speed of the combing elements with respect to the combing rotor 13 etc.).

Variation of the production speed.

Change of the comber waste percentage, for example, via écartement adjustment and feed amount adjustment etc.

Measurement of the combed sliver CV values

Control Variables for Changing the Combed Sliver CV Values:

Variation of the feed amount.

Variation in the take-off speed.

Variation of the overall draft, for example, by changing the draft between piecing roller 14 and web take-off and, when using a drafting system with levelling 50, through variation of the drafting system draft.

During start-up and shut-down of the machine, for example, on lap change-over or after sliver breakage, the drafts can be adapted, for example, to ensure a constant combed sliver quality.

Variation of the degree of overlap on transfer of the fibre tufts from the combing rotor 13 to the piecing roller 14.

Variation between same-direction and counter-direction piecing.

Sliver monitoring/sliver breakage monitoring of feed material.

Control Variable in Respect of Sliver Monitoring:

Machine stop in the event of sliver breakage.

Distance measurements of specific elements with respect to one another, for example, between combing rotor and turning rotor (FIG. 8), between the 15 and the combing rotor 13, between the piecing roller 14 and the combing rotor 13, between the feed roller 10 and the turning rotor 12, implemented, for example, by means of inductive proximity switches or displacement sensors (cf. FIG. 8).

Control Variables in Respect of Distance Measurements:

Elements, for example, the combing device 15, the piecing roller 14, the combing rotor 13 and the feed roller 10 can be automatically adjusted by an exactly predetermined amount. This enables, for example, the comber waste percentage to be specifically influenced. The adjustment can be effected by motor (not shown).

The representation of the rotor combing machine with the above-described regulation and control system is illustrated in FIGS. 9 and 10. Here, the rotor combing machine is fed either with wound laps (FIG. 10) or with slivers (FIG. 9).

According to FIG. 12, the rotatably mounted rollers 12 and 13 with clamping devices 19, 20 and 22, 23 are equipped additionally with suction channels 52 and 56, respectively (suction openings), which, in the region of the delivery between the supply device 8 and the roller 12 and in the region of the delivery between the rollers 12 and 13, influence the alignment and movement of the fibres being transported. In that way, the time for the taking up of the fibre material from the supply device 8 onto the first roller 12 and the delivery to the second roller 13 is significantly reduced, so that the nip rate can be increased. The suction openings 52, 56 are arranged within the rollers 12 and 13, respectively, and rotate with the rollers. At least one suction opening is associated with each clamping device 19, 20 and 22, 23 (nipper device). The suction openings 52, 56 are each arranged between a gripping element (upper nipper) and counter-element (lower nipper). In the interior of the rotors 12, 13 there is a reduced pressure region 53 to 55 and 57 to 59, respectively, created by the suction flow E at the suction openings 52, 56. The reduced pressure can be generated by connecting to a flow-generating machine. The suction flow E at the individual suction openings 52, 56 can be so switched between reduced pressure region and suction opening that it is applied only at particular selected angular positions on the roller circumference. For the purpose of the switching, valves or a valve pipe 54, 58 with openings 57 and 59, respectively, in the corresponding angular positions can be used. The release of the suction flow E may also be brought about by the movement of the gripping element (upper nipper). Furthermore, it is possible to arrange a region of reduced pressure only at the corresponding angular positions.

Additionally, a blowing flow can be provided in the region of the supply device 8 and/or in the region of transfer between the rollers. The source of the blowing flow (blowing nozzle 39) is arranged inside the feed roller 10 and has effect, through the air-permeable surface of the supply device or air passage openings, towards the outside in the direction of the first roller. Also, in the region of the supply device 8, the element for producing the blown air flow can be fixedly arranged, directly under or over the supply device 8. In the region of the transfer between the rollers 12, 13 the blown air current sources can be arranged at the perimeter of the first roller 12, directly under or over each nipper device. For the blown air generation there may be used compressed air nozzles or air blades.

The suction flow E can favourably influence and shorten not only the guiding, but also the separation process between the lap and the tufts to be removed in the region of the supply device 8.

As a result of the provision of additional air guide elements 60 and lateral screens 61, 62 the direction of the flow can be influenced and the air carried round with the rotors separated off. In that way the time for alignment can be further shortened. In particular, a screen element between the first rotor 12 and supply device 8 over the lap and a screen element on each side of the roller have proved useful.

The combed out fibre portion passes from the second roller 13 onto the piecing roller 14.

It will be appreciated that sensor devices provided at any one of the components identified in any one of FIGS. 4 to 12 may be used in combination with any one or more of the sensor devices described therein with reference to other components, with each sensor device advantageously being connected to the regulation and control device.

In use of the rotor combing machine according to the invention there is achieved a mechanical combing of the fibre material to be combed, that is, mechanical means are used for the combing. There is no pneumatic combing of the fibre material to be combed, that is, no air currents, e.g. suction and/or blown air currents, are used.

In the rotor combing machine according to the invention there are present rollers that rotate rapidly without interruption and that have clamping devices. Rollers that rotate with interruptions, stepwise or alternating between a stationary and rotating state are not used.

Although the foregoing invention has been described in detail by way of illustration and example for purposes of understanding, it will be obvious that changes and modifications may be practised within the scope of the appended claims.

What is claimed is:

1. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of the textile fibers at a distance from a free end of the bundle, wherein the first roller is a turning rotor and the second roller is a combing rotor, the directions of rotation of the turning rotor and the combing rotor being opposed;

a supply device adapted to supply the fibre bundle to the fibre-sorting device;

at least one mechanical device adapted to generate a combing action from the clamping site to the free end of the fibre bundle in order to loosen and remove non-clamped constituents, wherein the mechanical device is associated with at least one of the first and second rollers;

a control and regulation device coupled to at least one of the fibre-sorting device, the supply device and the at least one mechanical device;

a plurality of drive devices connected to the control and regulation device; and a plurality of measured value sensors adapted to detect machine-related and technical values relating to the fibres, wherein the measured value sensors are connected to the control and regulation device, and wherein the control and regulation device is adapted to process the measured machine-related and technical values and to emit electrical signals to connected elements to perform in each case at least one function.

2. An apparatus according to claim 1, wherein the connected elements comprise at least one of actuators, display devices, operating devices, and monitoring devices.

3. An apparatus according to claim 1, further comprising:

an analogue-digital converter connected to the measured value sensors, wherein the analogue-digital converter is further connected to and controllable by the electronic control and regulation device, and actuators adapted to adjust one or more machine settings, wherein the actuators are connected to the digital-analogue power converter.

4. An apparatus according to claim 1, wherein the electronic control and regulation device comprises a microprocessor having a memory adapted to store signals of the actual value of the measured value sensor and additional functions for internal and external control processes.

5. An apparatus according to claim 4, further comprising a setpoint device that is associated with the electronic control and regulation device.

6. An apparatus according to claim 1, wherein at least one of the plurality of measured value sensors is adapted to determine a CV value of fibre material feed.

7. An apparatus according to claim 6, wherein the measured value sensor comprises one of a measuring funnel or a microwave element to receive a sliver feed, and wherein the CV-value is determined by the measured value sensor at the sliver intake.

8. An apparatus according to claim 6, wherein the material feed is alterable in dependence upon the measured values.

9. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of the textile fibers at a distance from a free end of the bundle;

a supply device adapted to supply the fibre bundle to the fibre-sorting device;

at least one mechanical device adapted to generate a combing action from the clamping site to the free end of the fibre bundle in order to loosen and remove non-clamped constituents, wherein the mechanical device is associated with at least one of the first and second rollers;

a control and regulation device coupled to at least one of the fibre-sorting device, the supply device and the at least one mechanical device;

a plurality of drive devices connected to the control and regulation device;

a plurality of measured value sensors adapted to detect machine-related and technical values relating to the fibres, wherein the measured value sensors are connected to the control and regulation device, and wherein the control and regulation device is adapted to process the measured machine-related and technical values and to emit electrical signals to connected elements to perform in each case at least one function;

a piecing roller adapted to receive combed bundles from said second roller; and a take-off device adapted to take-off a web from the piecing roller, wherein at least one of the plurality of measured value sensors is adapted to monitor fibre material on the piecing roller, and wherein an alteration in the overall draft between piecing roller and a web take-off from the piecing roller is used as a control variable.

10. An apparatus according to claim 1, further comprising a drafting system with leveling arranged downstream of said second roller, wherein an alteration of a drafting system draft is used as a control variable.

11. An apparatus according to claim 10, wherein a calculation of the comber waste percentage is carried out from the determination of the input mass and the output mass of the fibre material.

12. An apparatus according to claim 10, wherein a control variable to change the comber waste percentage is adapted to adjust at least one of an écartement, a setting of the at least one mechanical device, a feed amount and a detaching distance between feed device and the first roller.

13. An apparatus according to claim 1, wherein the supply device comprises a feed tray, and wherein the measured value sensors comprise a sensor adapted to determine clamping forces of the feed tray.

14. An apparatus according to claim 13, wherein a nip geometry of the feed tray is alterable to change the clamping forces of the feed tray.

15. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of the textile fibers at a distance from a free end of the bundle;

a supply device adapted to supply the fibre bundle to the fibre-sorting device;

at least one mechanical device adapted to generate a combing action from the clamping site to the free end of the fibre bundle in order to loosen and remove non-clamped constituents, wherein the mechanical device is associated with at least one of the first and second rollers;

a control and regulation device coupled to at least one of the fibre-sorting device, the supply device and the at least one mechanical device;

a plurality of drive devices connected to the control and regulation device;

a plurality of measured value sensors adapted to detect machine-related and technical values relating to the fibres, wherein the measured value sensors are connected to the control and regulation device, and wherein the control and regulation device is adapted to process the measured machine-related and technical values and to emit electrical signals to connected elements to perform in each case at least one function, wherein at least one of the plurality of measured value sensors comprise one of a torque sensing device or a tension sensing device adapted to determine the separation force caused by separation of the fibre bundle from a material feed by a clamping device of said first roller, wherein the control and regulation device is arranged to adjust, as a control variable to change the separation force, one or more variables associated with at least one of nip rate, production speed, feed amount, and distance of the first roller from the supply device.

16. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of the textile fibers at a distance from a free end of the bundle;

a supply device adapted to supply the fibre bundle to the fibre-sorting device;

at least one mechanical device adapted to generate a combing action from the clamping site to the free end of the fibre bundle in order to loosen and remove non-clamped constituents, wherein the mechanical device is associated with at least one of the first and second rollers;

a control and regulation device coupled to at least one of the fibre-sorting device, the supply device and the at least one mechanical device;

a plurality of drive devices connected to the control and regulation device;

a plurality of measured value sensors adapted to detect machine-related and technical values relating to the fibres, wherein the measured value sensors are connected to the control and regulation device, and wherein the control and regulation device is adapted to process the measured machine-related and technical values and to emit electrical signals to connected elements to perform in each case at least one function; and pressure sensors adapted to determine reduced pressures in at least one of the first roller, the second roller, the piecing roller, the feed roller and the combing elements, wherein the control and regulation device is arranged to effect a specific adaptation of the set reduced pressures to one or more of the material, the production output, and the nip rate, based on the reduced pressure measurements.

17. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of the textile fibers at a distance from a free end of the bundle;

a supply device adapted to supply the fibre bundle to the fibre-sorting device;

at least one mechanical device adapted to generate a combing action from the clamping site to the free end of the fibre bundle in order to loosen and remove non-clamped constituents, wherein the mechanical device is associated with at least one of the first and second rollers;

a control and regulation device coupled to at least one of the fibre-sorting device, the supply device and the at least one mechanical device;

a plurality of drive devices connected to the control and regulation device;

a plurality of measured value sensors adapted to detect machine-related and technical values relating to the fibres, wherein the measured value sensors are connected to the control and regulation device, and wherein the control and regulation device is adapted to process the measured machine-related and technical values and to emit electrical signals to connected elements to perform in each case at least one function; and a device adapted to generate a jet of air for at least one of fibre bundle feed to the first roller, fibre bundle feed between the first roller and the second roller, optimum material feed to the combing elements, and assisted fibre bundle separation, wherein the control and regulation device is arranged to determine the jetting pressures, the control and regulation device being arranged to effect a specific adaptation of the set pressures as a control variable, based on the measurement of the jetting pressure.

18. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of the textile fibers at a distance from a free end of the bundle;

a supply device adapted to supply the fibre bundle to the fibre-sorting device;

at least one mechanical device adapted to generate a combing action from the clamping site to the free end of the fibre bundle in order to loosen and remove non-clamped constituents, wherein the mechanical device is associated with at least one of the first and second rollers;

a control and regulation device coupled to at least one of the fibre-sorting device, the supply device and the at least one mechanical device;

a plurality of drive devices connected to the control and regulation device;

a plurality of measured value sensors adapted to detect machine-related and technical values relating to the fibres, wherein the measured value sensors are connected to the control and regulation device, and wherein the control and regulation device is adapted to process the measured machine-related and technical values and to emit electrical signals to connected elements to perform in each case at least one function; and a separate measured value sensor adapted to measure the forces that occur during combing of the material.

19. An apparatus according to claim 18, wherein the control and regulation device is arranged to effect an adaptation of the production speed, depending on the combing forces ascertained, to change the combing forces.

20. An apparatus according to claim 18, wherein the control and regulation device is arranged to effect, as a control variable to change the combing forces, a variation of the relative speed of the combing elements with respect to the second roller, a variation of the comb surface, and a variation of the spacings of second roller and combing device, wherein the second roller includes a clamped fibre tuft.

21. An apparatus according to claim 1, wherein the measured value sensor comprises a sensor for an on-line measurement of the neps, bits of seed husk and other unwanted particles in a web formed downstream of said second roller, the control and regulation device being arranged to effect a change in the settings of the combing device as a control variable to change the content of neps and bits of seed husk or unwanted particle value.

22. An apparatus according to claim 1, wherein the measured value sensors comprise at least one sensor adapted to measure the fibre material thickness (CV) values of the combed fibre bundle.

23. An apparatus according to claim 22, wherein the control and regulation device is arranged to effect, as a control variable to change the combed sliver CV values, one or more adjustments of a variation in the feed amount, a variation in the take-off speed, a variation of the overall draft, adjustment of the drafts during start-up and shut-down of the machine, a variation in piecing of the fibre bundles from the second roller to an adjacent piecing roller, and a variation between same-direction and counter-direction piecing.

24. An apparatus according to claim 1, further comprising a sensor device adapted to monitor an output sliver for sliver breakage, the control and regulation device being arranged to stop the machine in the event of sliver breakage.

25. An apparatus according to claim 1, further comprising distance measuring sensor devices adapted to measure the distance of machine elements with respect to one another and in which, in dependence on one or more measured values obtained by said sensor devices, the distance or distances can be automatically adjusted by a predetermined amount.

* * * * *